US009328567B2

(12) United States Patent
Evans

(10) Patent No.: US 9,328,567 B2
(45) Date of Patent: May 3, 2016

(54) DOUBLE-ACTING SHOCK DAMPER FOR A DOWNHOLE ASSEMBLY

(75) Inventor: Robert W. Evans, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 696 days.

(21) Appl. No.: 13/343,108

(22) Filed: Jan. 4, 2012

(65) Prior Publication Data

US 2013/0168092 A1 Jul. 4, 2013

(51) Int. Cl.
*E21B 17/07* (2006.01)
*E21B 31/107* (2006.01)
*E21B 47/01* (2012.01)

(52) U.S. Cl.
CPC ..... *E21B 17/07* (2013.01); *E21B 31/107* (2013.01); *E21B 47/011* (2013.01)

(58) Field of Classification Search
CPC ..... E21B 19/09; E21B 31/113; E21B 47/01; E21B 47/011; E21B 17/07; E21B 31/107; E21B 31/1135
USPC ..... 166/178; 267/125; 175/321
See application file for complete search history.

(56) References Cited

U.S. PATENT DOCUMENTS 3,851,717 A * 12/1974 Berryman ..... 175/297
4,059,167 A * 11/1977 Berryman ..... 175/297
4,194,582 A * 3/1980 Ostertag ..... 175/321
4,413,516 A 11/1983 Croom, Jr. et al.
4,434,863 A * 3/1984 Garrett ..... 175/321
4,552,230 A 11/1985 Anderson et al.
4,566,546 A * 1/1986 Evans ..... 175/297
4,628,995 A 12/1986 Young et al.
4,901,806 A 2/1990 Forrest
5,209,577 A 5/1993 Swatek
5,232,060 A 8/1993 Evans
5,624,001 A * 4/1997 Evans ..... 175/299

(Continued)

FOREIGN PATENT DOCUMENTS

EP 0830493 B1 5/2000
WO 98/40599 A1 9/1998

(Continued)

OTHER PUBLICATIONS

PCT/US2013/020033 International Search Report and Written Opinion Dated Apr. 16, 2013 (12 p.).

(Continued)

*Primary Examiner* — Shane Bomar
*Assistant Examiner* — Christopher Sebesta
(74) *Attorney, Agent, or Firm* — Chamberlain Hrdlicka

(57) ABSTRACT

A downhole assembly, including a downhole tool, a downhole force-creating device, and a shock damper. The shock damper includes a hollow housing including an annular shoulder near each end and extending radially inward from the housing. The damper also includes a mandrel located at least partially inside the housing to form an annulus between the mandrel and the housing, the mandrel including an annular shoulder near each end and extending radially outward from the mandrel. A spring is located in an annular cavity formed by the annulus and between both the housing shoulders and the mandrel shoulders. The mandrel is movable relative to the housing to an expanded position in one direction and to a compressed position in the other direction.

18 Claims, 4 Drawing Sheets

(56) References Cited

U.S. PATENT DOCUMENTS

| | | | | |
|---|---|---|---|---|
| 6,290,004 | B1 | 9/2001 | Evans | |
| 6,386,545 | B1 | 5/2002 | Evans | |
| 6,412,614 | B1 * | 7/2002 | Lagrange et al. | 188/281 |
| 6,481,495 | B1 | 11/2002 | Evans | |
| 6,808,455 | B1 | 10/2004 | Solorenko et al. | |
| 6,988,551 | B2 | 1/2006 | Evans | |
| 7,290,604 | B2 | 11/2007 | Evans | |
| 7,311,149 | B2 | 12/2007 | Evans | |
| 7,510,008 | B2 | 3/2009 | Evans | |
| 7,854,425 | B2 | 12/2010 | Evans | |
| 8,256,509 | B2 | 9/2012 | Evans | |
| 2004/0140090 | A1 * | 7/2004 | Mason et al. | 166/242.1 |
| 2005/0093201 | A1 | 5/2005 | Groth | |
| 2010/0319930 | A1 | 12/2010 | Evans | |

FOREIGN PATENT DOCUMENTS

| | | | |
|---|---|---|---|
| WO | 9919596 | A2 | 4/1999 |
| WO | 2009030925 | A2 | 3/2009 |
| WO | 2010/085321 | A1 | 7/2010 |

OTHER PUBLICATIONS

Cobern, M.E., et al., "Drilling Tests of an Active Vibration Damper," SPE/IADC Drilling Conference, Amersterdam, The Netherlands, Feb. 20-22, 2007 (SPE/IADC 105400) (10 p.).

Australian Examination Report dated Jun. 3, 2015, for Australian Application No. 2013206965 filed on Jan. 3, 2013.

* cited by examiner

DOUBLE-ACTING SHOCK DAMPER FOR A DOWNHOLE ASSEMBLY

BACKGROUND

The invention relates generally to downhole tools. More particularly, the invention relates to shock dampers for jars or other downhole equipment that apply an impact force to a downhole assembly.

In oil and gas well operations, it is frequently necessary to apply an axial blow to a tool or tool string that is positioned downhole. For example, application of axial force to a downhole string may be desirable to dislodge drilling or production equipment that is stuck in a wellbore. Another circumstance involves the retrieval of a tool or string downhole that has been separated from its pipe or tubing string. The separation between the pipe or tubing and the stranded tool—or fish—may be the result of structural failure or a deliberate disconnection initiated from the surface. Another example of creating force in downhole operations is with the use of casing perforation tools.

As an example, jars have been used in petroleum well operations for several decades to enable operators to deliver axial impacts to stuck or stranded tools and strings. Drilling jars are frequently employed when either drilling or production equipment gets stuck in the well bore. The drilling jar is normally placed in the pipe string in the region of the stuck object and allows an operator at the surface to deliver a series of impact blows to the drill string via manipulation of the drill string. These impact blows are intended to dislodge the stuck object, thereby enabling continued downhole operations. Fishing jars are inserted into the well bore to retrieve a stranded tool or fish. Fishing jars are provided with a mechanism that is designed to firmly grasp the fish so that the fishing jar and the fish may be lifted together from the well. Many fishing jars are also provided with the capability to deliver axial blows to the fish to facilitate retrieval.

Conventional jars typically include an inner mandrel disposed in an outer housing. The mandrel is permitted to move axially relative to the housing and has a hammer formed thereon, while the housing includes an anvil positioned adjacent to the mandrel hammer. By impacting the anvil with the hammer at a relatively high velocity, a substantial jarring force is imparted to the stuck drill string. If the jarring force is sufficient, the stuck string will be dislodged and freed. However, while the jarring force may be sufficient to dislodge the stuck string, the force may be so large as to damage the remaining components of the downhole tool if too much force is transferred to the other components.

BRIEF DESCRIPTION OF THE DRAWINGS

For a detailed description of the preferred embodiments of the invention, reference will now be made to the accompanying drawings in which.

DETAILED DESCRIPTION

Figure 1:
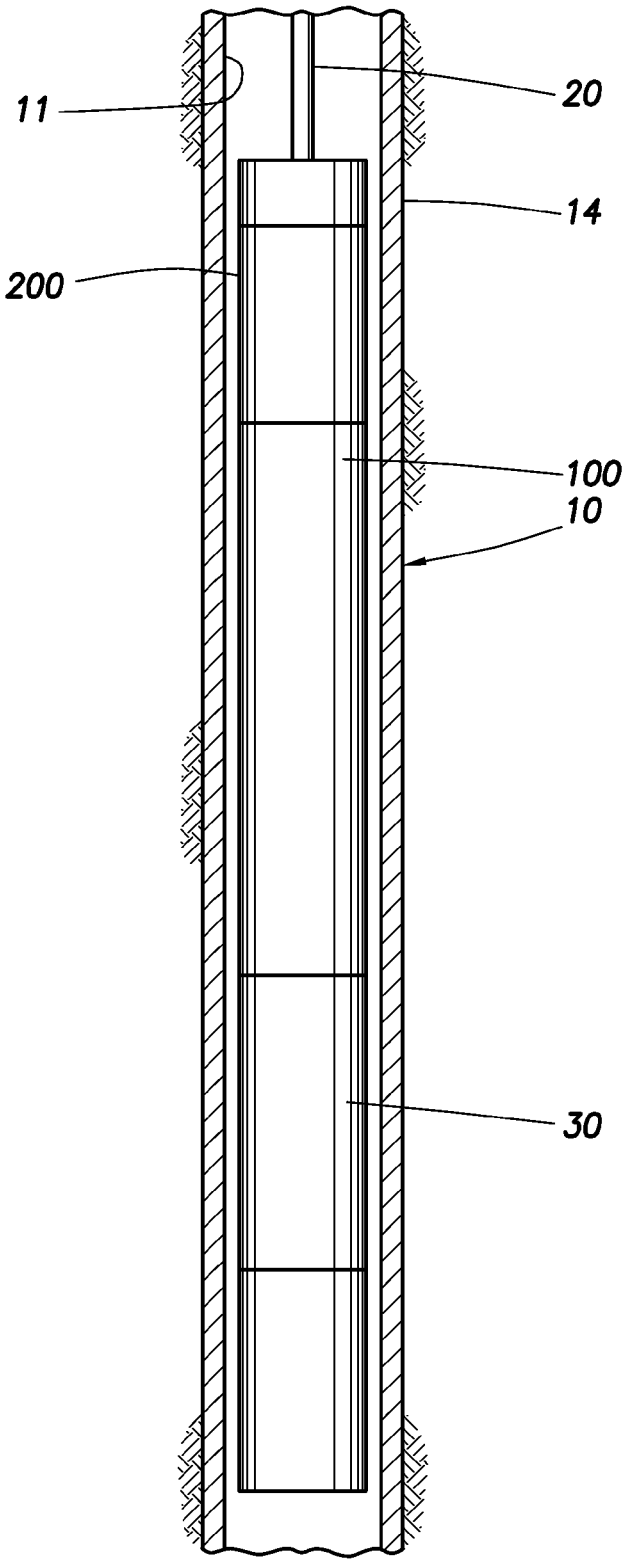
FIG. 1 shows a schematic view of a downhole assembly including an embodiment of a shock damper for a downhole force-creating device in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, a downhole assembly 10 is shown disposed in a borehole 11 extending through an earthen formation. The borehole 11 includes a casing 14 that extends downhole from the surface. In this embodiment, the assembly 10 is lowered downhole with a wireline string 20 extending through the casing 14. However, in general, the downhole assembly (e.g., assembly 10) may be run downhole by any suitable means including, without limitation, a pipe string, a slickline, a drill string, a sucker rod, or other suitable device. The assembly 10 includes one or more downhole tools 30 for performing downhole operations. In general, the tools 30 may include any suitable tool(s) for performing downhole operations including, without limitation, formation testing tools, perforation equipment, fracturing tools, fishing tools, etc.

As may be necessary to traverse particular producing formations, the borehole 11 may include generally straight sections and curved sections. In reality, both straight and curved sections may include various kinks and twists, which generally increase the probability of the assembly 10 becoming stuck downhole. Consequently, in this embodiment, a downhole force-creating device 100 is included in the assembly 10 in the form of a downhole jar. In the event the assembly 10 becomes stuck in the borehole 11, the jar 100 may be triggered or fired to provide an abrupt, axial force sufficient to dislodge the assembly 10. It is appreciated though that the jar 100 is simply one non-limiting example of a downhole force-creating device. Other examples could include items such as perforation guns for use in casing perforation operations.

While the abrupt, axial force provided by the jar 100 is helpful to dislodge the downhole assembly 10 from being stuck, the force transferred to the remainder of the downhole assembly 10 might damage other assembly components. To dampen the force transferred to the other assembly components, the downhole assembly 10 also includes a shock damper 200. The shock damper may be located between the wireline 20 and the jar 100 as shown or anywhere else on the assembly 10. When the jar 100 triggers or fires, the shock damper 200 dampens the force transmitted from the jar 100 to the remainder of the downhole assembly 10 as described below.

Figure 2:
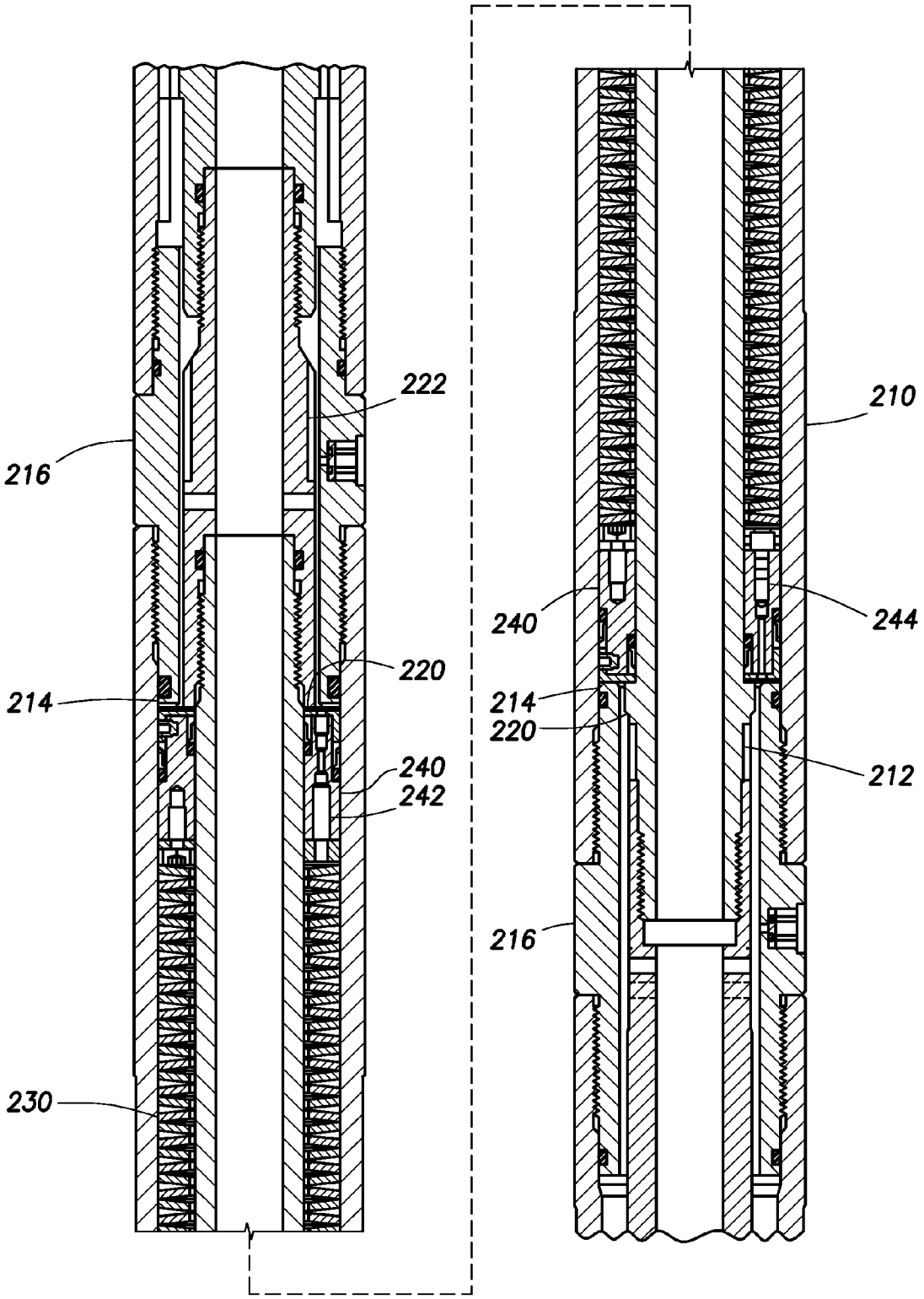
FIG. 2 shows a cross-sectional view of the shock damper in the neutral position.

FIG. 2 shows a cross-section of the shock damper in the neutral position. The shock damper 200 is designed to be placed in-line with the other components that make up the assembly 10. The shock damper 200 includes a hollow outer housing 210 and a mandrel 212 located at least partially inside the housing 210 to form an annulus between the mandrel 212 and the housing 210. Both the housing 210 and the mandrel 212 are connected to the other components in the assembly 10 while still allowing the mandrel 212 to move relative to the housing 210.

The housing 210 includes annular shoulders 214 near each end and extending radially inward into the hollow cavity. The housing shoulders 214 are optionally formed by shoulder ends 216 sealingly attached to each end of the housing 210, the shoulder ends 216 having a smaller internal dimension than the housing 210. This is an optional configuration and it is appreciated that the shoulders 214 can be made in other configurations.

The mandrel 212 likewise includes annular shoulders 220 near each end but these shoulders 220 extend radially outward from the mandrel 212. As shown in FIG. 2, one mandrel shoulder 220 is formed on the mandrel itself and the second mandrel shoulder is formed on a mandrel extension 222 attached to the mandrel 212. This is an optional configuration and it is appreciated that the shoulders 220 can be reversed as well as made in other configurations.

In the neutral position as shown in FIG. 2, the shoulders 214 of the housing 210 and the shoulders 220 of the mandrel 212 are aligned and help form an adjustable annular cavity bounded by the housing 210 and the mandrel 212. A spring 230 is located inside the annular cavity formed by the annulus between the housing 210 and the mandrel 212 and between both the housing shoulders 214 and the mandrel shoulders 200. The spring 230 is optionally shown as a stack of Belleville springs but can be formed in any suitable configuration, including a continuous spring. Typically, the spring 230 is designed to support the weight of the downhole assembly 200 while located downhole without being completely compressed and preferably keeping the damper 200 in the neutral position. This allows the spring 230 to compress in response to force transferred to the mandrel 212 as described below.

Located on each side of the spring 230 in the cavity are annular pistons 240. The annular pistons 240 are thick enough to overlap some of both the housing annular shoulders 220 and the mandrel annular shoulders 222. The annular pistons 240 may also be thick enough to fill the annular gap between the mandrel 212 and the housing 210. The pistons 240 also include seals against the inside of the housing 210 and the outside of the mandrel 212 to seal the annular cavity between the pistons 240. The annular cavity is fluid-filled and at least one piston 240 includes at least one port 242 that controls the flow of fluid through the piston 240 and into and out of the cavity so as to affect the dynamic response of the spring 230. The port(s) 242 may be, for example, a JEVA orifice installed in the piston 240. The port(s) 242 allow fluid inside the cavity to balance with hydrostatic pressure as well as adjust for pressure changes due to temperature changes. A piston 240 may also include at least one check valve 244 that allows fluid into the cavity but not out of the cavity. Preferably, between the two pistons 240, there is at least one port 242 and one check valve 244. The port 242 and the check valve 244 can be located on the same piston 240 or different pistons 240. There also can be more than one port 242 and one check valve 244 in either piston 240 depending on the desired operating characteristics of the damper 200. For example, if the protected tools are subjected to drilling jar impacts while coupled to drill pipe from the surface the impact loads may be in the range of 500,000 pounds (2,224,111 Newtons), which would necessitate an orifice with much greater restriction than the case of a wireline jar that may only create a 50,000 pound (222,411 Newton) impact load.

Figure 3:
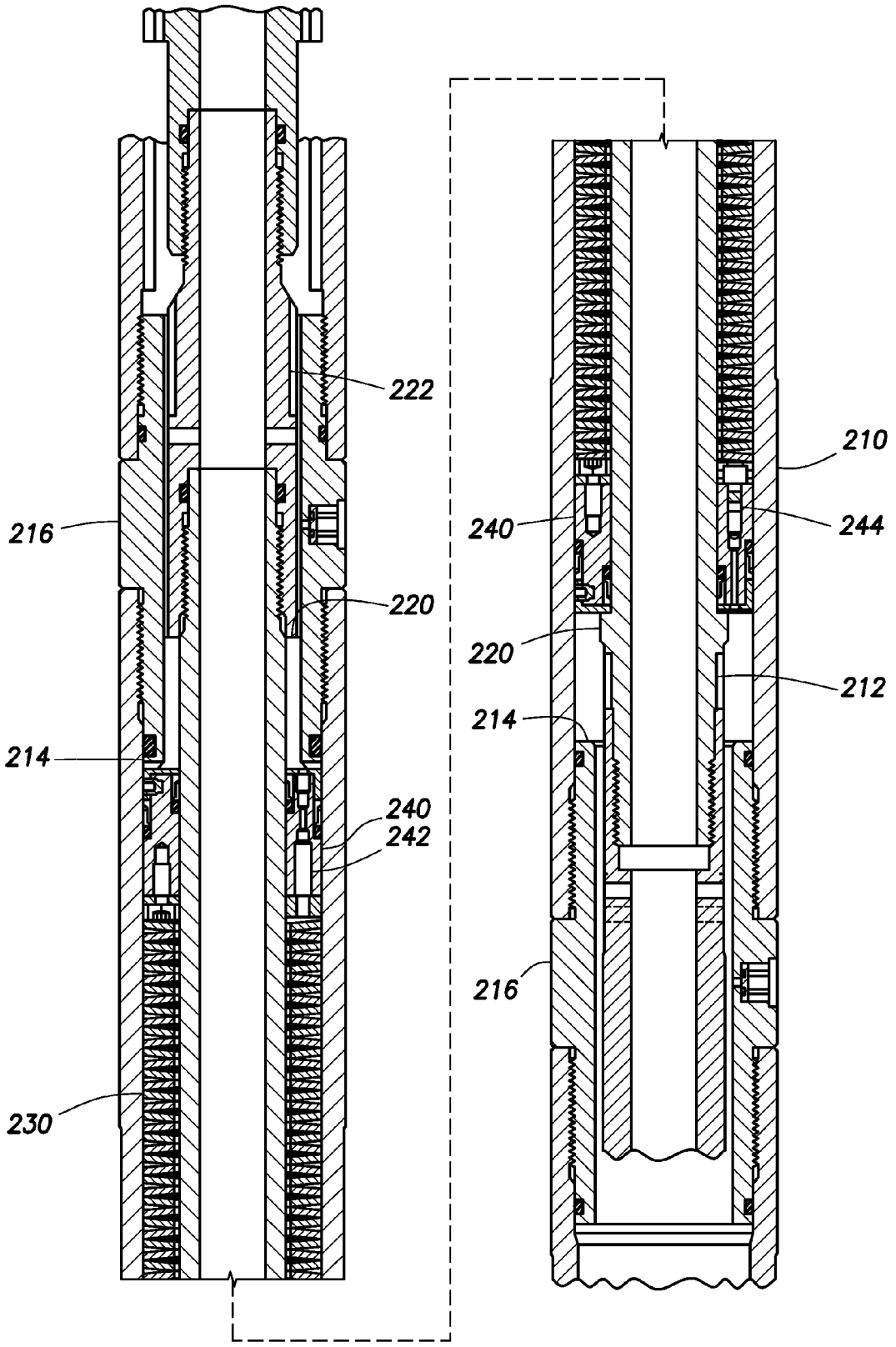
FIG. 3 shows a cross-sectional view of the shock damper in the expanded position.
Figure 4:
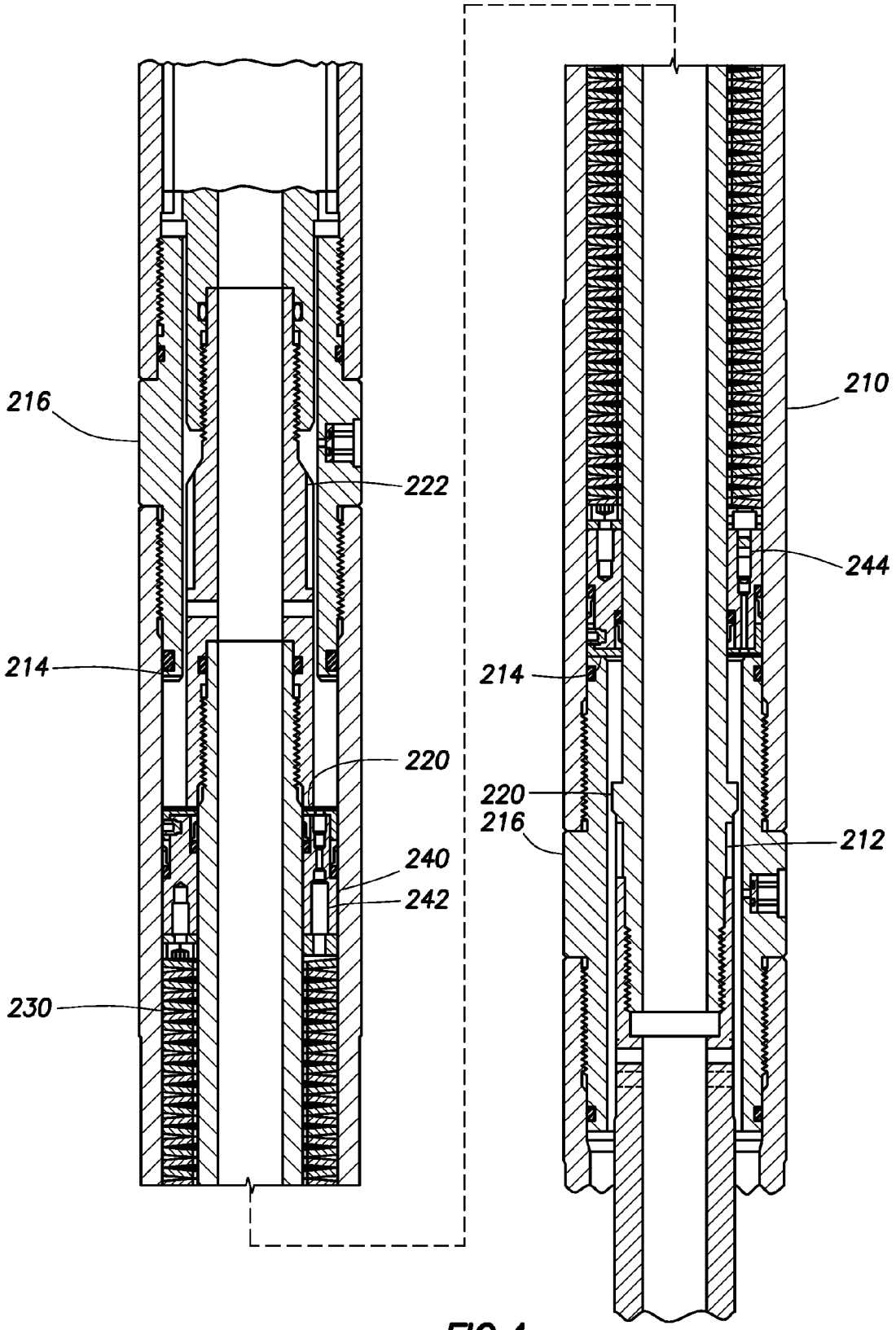
FIG. 4 shows a cross-sectional view of the shock damper in the compressed position.

As shown in FIGS. 3 and 4, actuation of the jar 100 provides an abrupt, axial force to help dislodge the assembly 10. The force from the jar 100 is dampened as the damper 200 restricts movement of the mandrel 212 relative to the housing 210 from between an expanded position in one axial direction and a compressed position in the other axial direction. When the jar 100 actuates, the force is transferred to the mandrel 212 to move the mandrel 212 towards either the expanded position shown in FIG. 3 or the compressed position shown in FIG. 4. Movement of the mandrel 212 relative to the housing moves one of the mandrel shoulders 220 towards the housing shoulder 214 on the opposite side of the spring 230. Because the pistons 240 are thick enough to overlap some of both the housing annular shoulders 214 and the mandrel annular shoulders 220, movement of one of the mandrel shoulders 200 towards a housing shoulder on the opposite side of the spring 230 also moves the pistons 240 towards each other, compressing the spring 230. At least some of the force from the jar 100 is thus used to compress the spring 230 through movement of the mandrel 212 relative to the housing. Compressing the spring 230 thus dampens the force transferred to the rest of the downhole tool components.

Also, as the mandrel 212 moves and compresses the spring 230, the force transferred and stored in the spring 230 is eventually released and used to move the mandrel 212 back and toward the opposition position, whether it be the expanded or compressed position. Thus, once the initial force from the jar 100 is transferred to the mandrel 212, the spring 230 continues to move the mandrel 212 back and forth between the expanded and compressed positions shown in FIGS. 3 and 4 until the force is dissipated enough that the spring 230 is no longer compressed and the mandrel 212 returns to its neutral position shown in FIG. 2. The shock damper 200 is thus able to be used repeatedly to absorb force from multiple uses of the jar 100.

Although the present invention has been described with respect to specific details, it is not intended that such details should be regarded as limitations on the scope of the invention, except to the extent that they are included in the accompanying claims.

What is claimed is:

1. A downhole assembly, including:

a downhole tool;

a downhole force-creating device; and a shock damper including:

a hollow housing including an annular housing shoulder near each end and extended radially inward from the housing;

a mandrel located at least partially inside the housing to form an annulus between the mandrel and the housing, the mandrel including an annular mandrel shoulder near each end and extended radially outward from the mandrel;

a spring located in an annular cavity defined by the annulus and between both the annular housing shoulders and the annular mandrel shoulders;

a first annular piston located in the annular cavity between a first end of the spring and one annular housing shoulder, wherein the first annular piston is configured to seal against the housing and the mandrel;

a second annular piston located in the annular cavity between a second end of the spring and the other annular housing shoulder, wherein the second annular piston is configured to seal against the housing and the mandrel;

the mandrel being movable relative to the housing to an expanded position in one direction and to a compressed position in the other direction;

the spring being compressible by one of the annular housing shoulders on one end and one of the annular mandrel shoulders on the opposite end as the mandrel moves between the expanded and compressed positions, the compression of the spring resisting relative movement between the mandrel and the housing and absorb the force moving the mandrel;

wherein the first annular piston or the second annular piston includes a check valve configured to allow one way fluid communication through the first annular piston or the second annular piston into the annular cavity; and wherein the first annular piston or the second annular piston includes a port configured to allow fluid communication into and out of the annular cavity.

2. The downhole assembly of claim 1, wherein the annular housing shoulders are formed by shoulder ends attached to each end of the housing, the shoulder ends having a smaller internal dimension than the housing.

3. The downhole assembly of claim 1, wherein one annular mandrel shoulder is formed on the mandrel itself and another annular mandrel shoulder is formed on a mandrel extension attached to the mandrel.

4. The downhole assembly of claim 1, wherein the spring includes a stack of Belleville springs.

5. The downhole assembly of claim 1, wherein the annular cavity is fluid-filled and a piston includes a port that can control the flow of fluid through the piston into and out of the cavity so as to affect the dynamic response of the spring.

6. The downhole assembly of claim 5, wherein the pressure of the fluid in annular cavity is balanced with hydrostatic pressure.

7. A method of dampening a shock transferred to a downhole assembly, including:

transferring a force from the shock to a mandrel located at least partially inside a hollow housing to move the mandrel relative to the housing between an expanded position in one direction and to a compressed position in the other direction;

resisting the movement of the mandrel between both the expanded position and the compressed position by compressing a spring to dampen the shock transferred to the downhole assembly;

resisting the movement of the mandrel in both the expanded position and the compressed position by flowing a fluid through a port extending through a first annular piston located in the housing between an end of the spring and an annular shoulder of the housing, wherein the first annular piston is configured to seal against the housing and the mandrel; and allowing one way fluid communication through a check valve of a second annular piston located in the housing, wherein the second annular piston is configured to seal against the housing and the mandrel.

8. The method of claim 7, wherein the force is created by activating a downhole force-creation device.

9. The method of claim 7, wherein the spring is located in a fluid-filled cavity, the method further including balancing the fluid in the cavity with hydrostatic pressure.

10. The method of claim 9, further comprising controlling the rate of fluid flow into and out of the cavity as the spring compresses to affect the dynamic response of the spring.

11. The method of claim 7, further including transferring the force from actuating a downhole force-creating device.

12. The method of claim 7, further including:

positioning the mandrel and housing coaxially; and resisting the movement of the mandrel as it moves axially in both directions between the expanded and compressed positions.

13. A shock damper for a downhole force-creating device, the shock damper including:

a hollow housing including an annular housing shoulder near each end and extended radially inward from the housing;

a mandrel located at least partially inside the housing to form an annulus between the mandrel and the housing, the mandrel including an annular mandrel shoulder near each end and extended radially outward from the mandrel;

a spring located in an annular cavity defined by the annulus and between both the annular housing shoulders and the annular mandrel shoulders;

a first annular piston located in the annular cavity between a first end of the spring and one annular housing shoulder, wherein the first annular piston is configured to seal against the housing and the mandrel a second annular piston located in the annular cavity between a second end of the spring and the other annular housing shoulder, wherein the second annular piston is configured to seal against the housing and the mandrel;

the mandrel being movable relative to the housing to an expanded position in one direction and to a compressed position in the other direction;

the spring being compressible by one of the annular housing shoulders on one end and one of the annular mandrel shoulders on the opposite end as the mandrel moves between the expanded and compressed positions, the compression of the spring resisting relative movement between the mandrel and the housing and absorb the force moving the mandrel;

wherein one of the annular pistons includes a check valve configured to allow one way fluid communication through the annular piston into the annular cavity; and wherein one of the annular pistons includes a port configured to allow fluid communication into and out of the annular cavity.

14. The shock damper of claim 13, wherein the annular housing shoulders are formed by shoulder ends attached to each end of the housing, the shoulder ends having a smaller internal dimension than the housing.

15. The shock damper of claim 13, wherein one annular mandrel shoulder is formed on the mandrel itself and another annular mandrel shoulder is formed on a mandrel extension attached to the mandrel.

16. The shock damper of claim 13, wherein the spring includes a stack of Belleville springs.

17. The shock damper of claim 13, wherein the annular cavity is fluid-filled and a piston includes a port that can control the flow of fluid through the piston into and out of the cavity so as to affect the dynamic response of the spring.

18. The shock damper of claim 17, wherein the pressure of the fluid in annular cavity is balanced with hydrostatic pressure.

* * * * *